US011251521B2

(12) United States Patent
Wu et al.

(10) Patent No.: US 11,251,521 B2
(45) Date of Patent: Feb. 15, 2022

(54) ANTENNA STRUCTURE

(71) Applicant: Wistron NeWeb Corp., Hsinchu (TW)

(72) Inventors: Tzu-Min Wu, Hsinchu (TW); Kuo-Jen Lai, Hsinchu (TW); Kuang-Yuan Ku, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 51 days.

(21) Appl. No.: 17/014,502

(22) Filed: Sep. 8, 2020

(65) Prior Publication Data

US 2021/0249766 A1 Aug. 12, 2021

(30) Foreign Application Priority Data

Feb. 7, 2020 (TW) ..... 109103799

(51) Int. Cl.

| | |
|---|---|
| ***H01Q 1/52*** | (2006.01) |
| ***H01Q 9/06*** | (2006.01) |
| ***H01Q 5/48*** | (2015.01) |
| ***H01Q 1/24*** | (2006.01) |
| ***H01Q 1/38*** | (2006.01) |

(52) U.S. Cl.

CPC ..... *H01Q 1/521* (2013.01); *H01Q 1/243* (2013.01); *H01Q 1/38* (2013.01); *H01Q 5/48* (2015.01); *H01Q 9/065* (2013.01)

(58) Field of Classification Search

CPC ..... H01Q 5/48; H01Q 9/065; H01Q 1/521; H01Q 1/243; H01Q 1/38

See application file for complete search history.

(56) References Cited

U.S. PATENT DOCUMENTS

| | | | | |
|---|---|---|---|---|
| 7,336,229 | B1 * | 2/2008 | Tseng | H01Q 1/2258 343/700 MS |
| 8,134,517 | B2 | 3/2012 | Wang et al. | |
| 8,823,590 | B2 * | 9/2014 | Tseng | H01Q 9/42 343/700 MS |
| 11,198,011 | B2 * | 12/2021 | Yeh | A61N 1/372 |

(Continued)

FOREIGN PATENT DOCUMENTS

| | | | | |
|---|---|---|---|---|
| CN | 105122541 A | * | 12/2015 | H01Q 9/0421 |
| JP | 2009182608 A | * | 8/2009 | H01Q 1/243 |

(Continued)

*Primary Examiner* — Graham P Smith
*Assistant Examiner* — Jae K Kim
(74) *Attorney, Agent, or Firm* — McClure, Qualey & Rodack, LLP

(57) ABSTRACT

An antenna structure includes a substrate, a feeding radiation element, a first grounding radiation element, a second grounding radiation element, and a first circuit element. The substrate has a first surface and a second surface which are opposite to each other. The feeding radiation element includes a body portion, a bridging portion, and an extension portion. The body portion has a feeding point. The bridging portion is coupled between the body portion and the extension portion. The first grounding radiation element is coupled to a ground voltage. The first circuit element is coupled between the first grounding radiation element and the second grounding radiation element. The bridging portion of the feeding radiation element is disposed on the first surface of the substrate. The first circuit element is disposed on the second surface of the substrate.

20 Claims, 18 Drawing Sheets

(56) References Cited

U.S. PATENT DOCUMENTS

| | | | | |
|---|---|---|---|---|
| 2012/0009983 | A1 | 1/2012 | Mow et al. | |
| 2018/0083353 | A1* | 3/2018 | Tseng | H01Q 1/422 |
| 2020/0185813 | A1* | 6/2020 | Chang | H01Q 1/2291 |
| 2021/0392785 | A1* | 12/2021 | Huang | H05K 7/20445 |

FOREIGN PATENT DOCUMENTS

| | | | | |
|---|---|---|---|---|
| JP | WO2008099444 | A1 * | 5/2010 | H01Q 1/38 |
| KR | 101708569 | B1 * | 2/2017 | |
| TW | 201017978 | A | 5/2010 | |
| WO | WO-2004097980 | A1 * | 11/2004 | H01Q 21/30 |
| WO | WO-2012164793 | A1 * | 12/2012 | H01Q 1/243 |
| WO | WO-2013157260 | A1 * | 10/2013 | H01Q 5/364 |

* cited by examiner

601

602

603

604

ANTENNA STRUCTURE

CROSS REFERENCE TO RELATED APPLICATIONS

This application claims priority of Taiwan Patent Application No. 109103799 filed on Feb. 7, 2020, the entirety of which is incorporated by reference herein.

BACKGROUND OF THE INVENTION

Field of the Invention

The disclosure generally relates to an antenna structure, and more particularly, it relates to a UWB(Ultra-Wideband) antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

BRIEF SUMMARY OF THE INVENTION

In an exemplary embodiment, the disclosure is directed to an antenna structure that includes a substrate, a feeding radiation element, a first grounding radiation element, a second grounding radiation element, and a first circuit element. The substrate has a first surface and a second surface which are opposite to each other. The feeding radiation element includes a body portion, a bridging portion, and an extension portion. The body portion has a feeding point. The bridging portion is coupled between the body portion and the extension portion. The first grounding radiation element is coupled to a ground voltage. The first circuit element is coupled between the first grounding radiation element and the second grounding radiation element. The bridging portion of the feeding radiation element is disposed on the first surface of the substrate. The first circuit element is disposed on the second surface of the substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
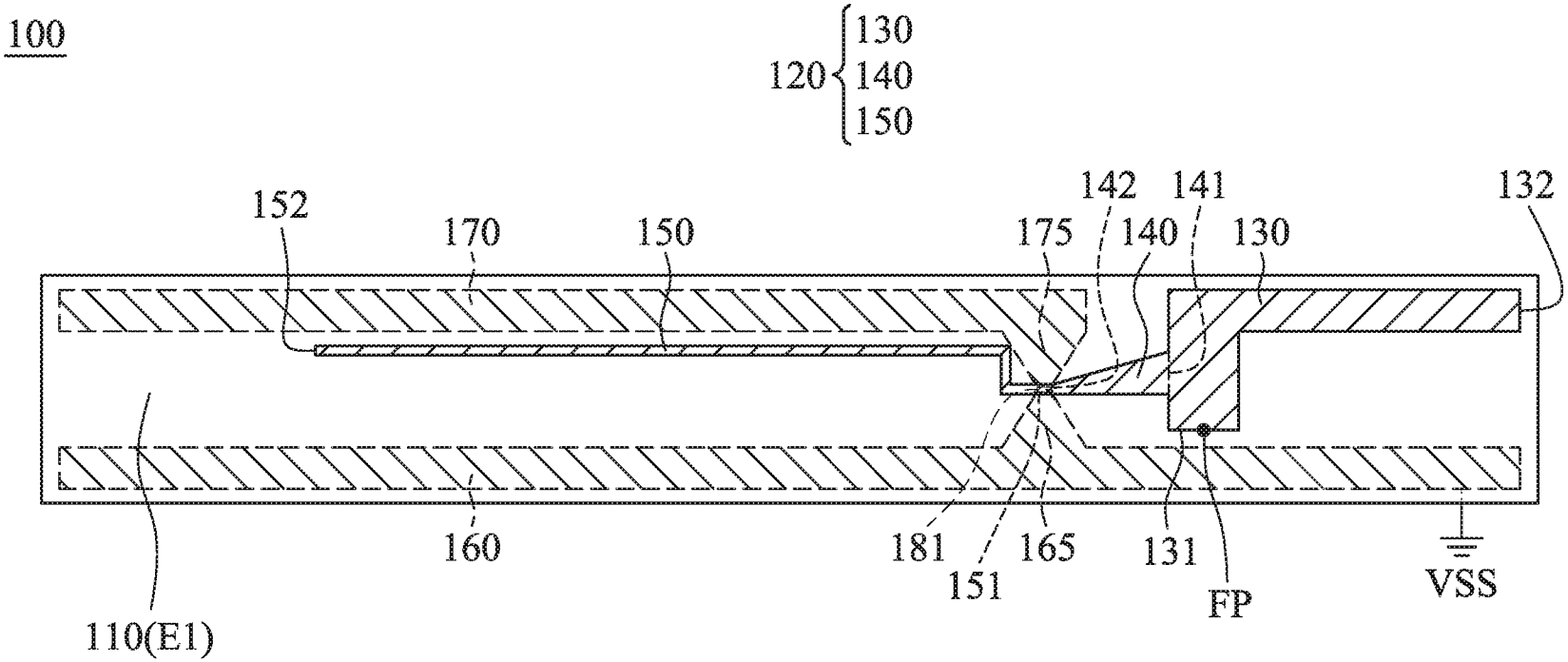
FIG. 1A is a top view of an antenna structure according to an embodiment of the invention.

FIG. 1A is a top view of an antenna structure 100 according to an embodiment of the invention. The antenna structure 100 may be applied to a mobile device, such as a smartphone, a tablet computer, or a notebook computer. As shown in FIG. 1A, the antenna structure 100 at least includes a substrate 110, a feeding radiation element 120, a first grounding radiation element 160, a second grounding radiation element 170, and a first circuit element 181. The feeding radiation element 120 includes a body portion 130, a bridging portion 140, and an extension portion 150. The feeding radiation element 120, the first grounding radiation element 160, and the second grounding radiation element 170 may all be made of metal materials, such as copper, silver, aluminum, iron, or their alloys.

Figure 1B:
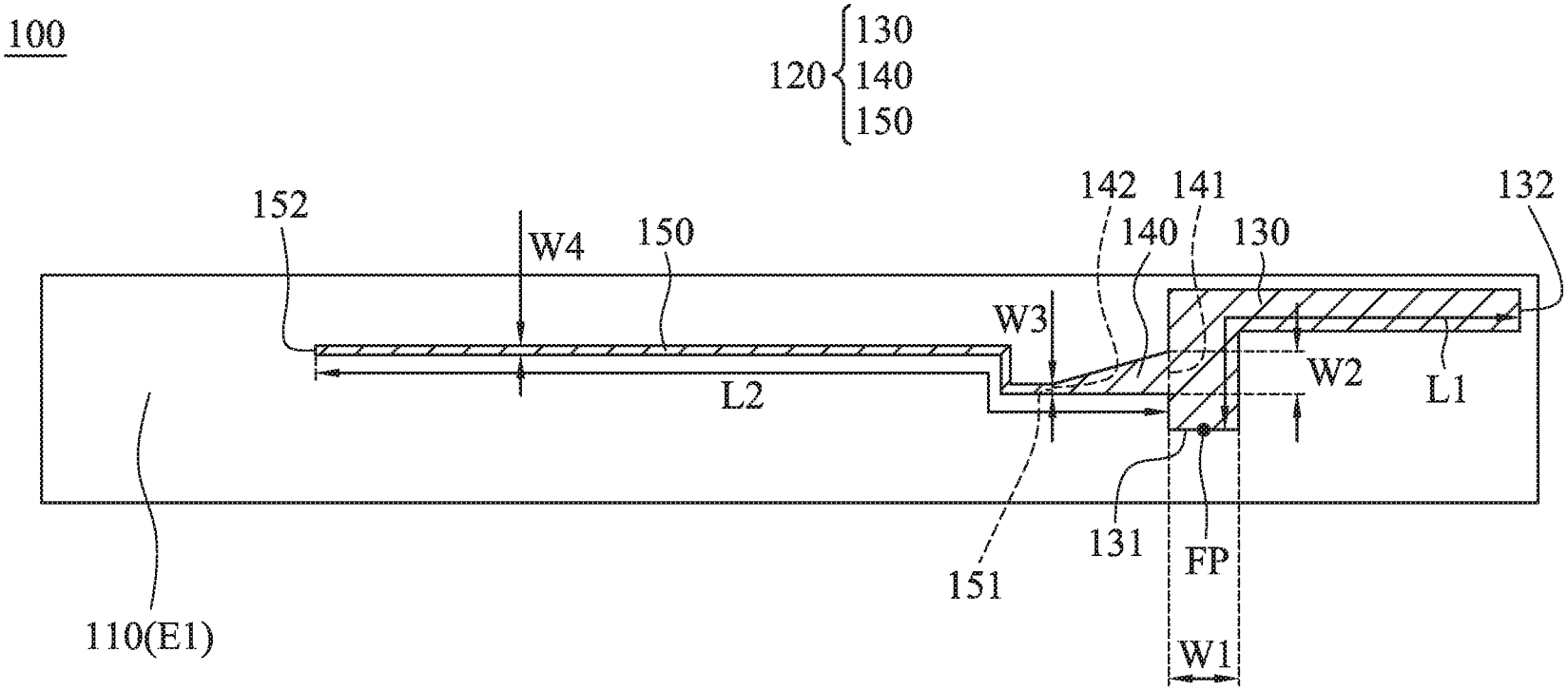
FIG. 1B is a top view of partial elements of an antenna structure on a first surface of a substrate according to an embodiment of the invention.
Figure 1C:
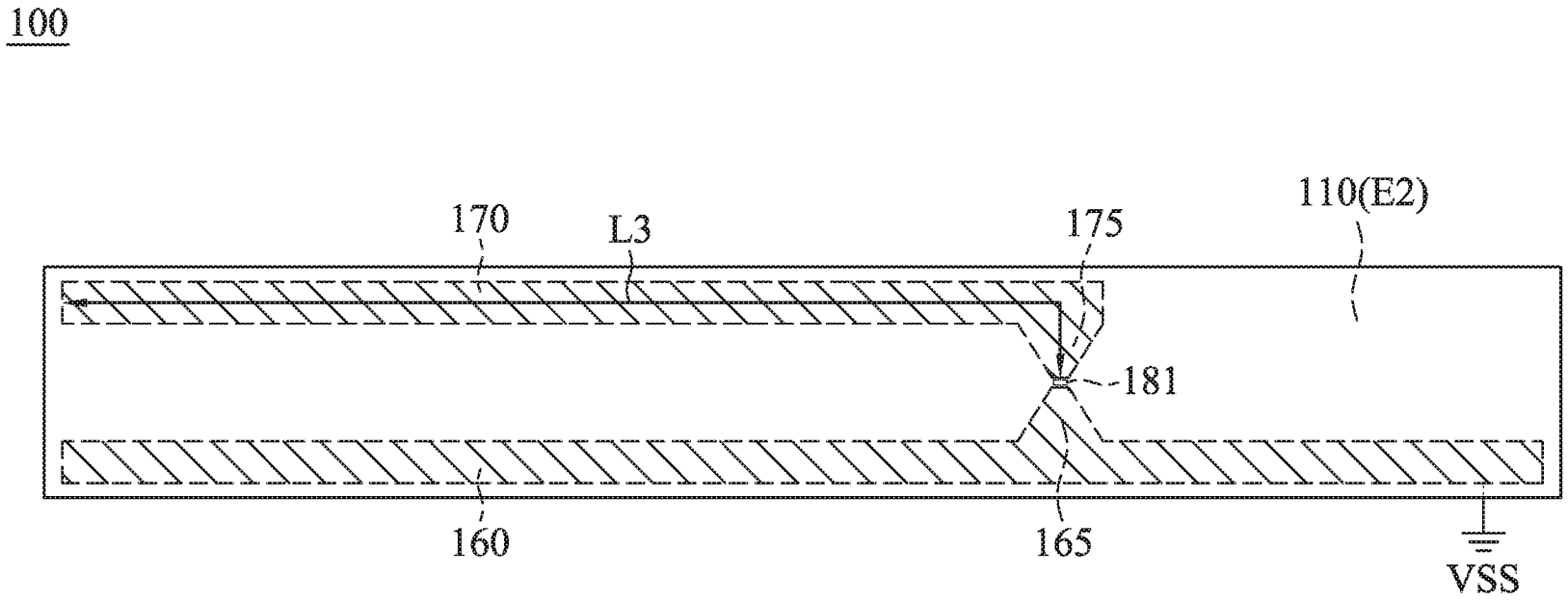
FIG. 1C is a see-through view of other partial elements of an antenna structure on a second surface of a substrate according to an embodiment of the invention.
Figure 1D:
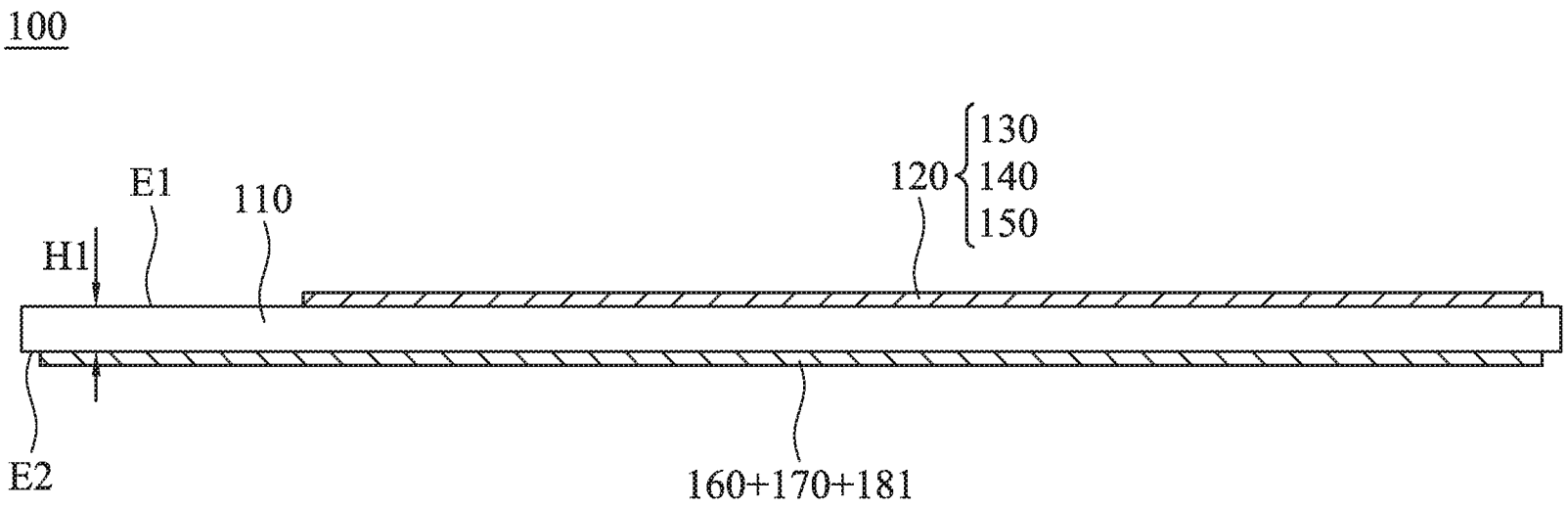
FIG. 1D is a side view of an antenna structure according to an embodiment of the invention.

The substrate 110 may be an FR4 (Flame Retardant 4) substrate, an LDS (Laser Direct Structuring) plastic material, or a flexible PI (Polyimide) substrate. The substrate 110 has a first surface E1 and a second surface E2 which are opposite to each other. The feeding radiation element 120 is disposed on the first surface E1 of the substrate 110. The first grounding radiation element 160 is disposed on the substrate 110. FIG. 1B is a top view of partial elements of the antenna structure 100 on the first surface E1 of the substrate 110 according to an embodiment of the invention. FIG. 1C is a see-through view of other partial elements of the antenna structure 100 on the second surface E2 of the substrate 110 according to an embodiment of the invention (i.e., the substrate 110 is considered as a transparent element). FIG. 1D is a side view of the antenna structure 100 according to an embodiment of the invention. Please refer to FIG. 1A, FIG. 1B, FIG. 1C, and FIG. 1D together to understood the invention.

The body portion 130 of the feeding radiation element 120 may substantially have an L-shape. Specifically, the body portion 130 has a first end 131 and a second end 132. A feeding point FP is positioned at the first end 131 of the body portion 130. The second end 132 of the body portion 130 is an open end. The feeding point FP may also be coupled to a signal source (not shown), such as an RF (Radio Frequency) module, for exciting the antenna structure 100.

The bridging portion 140 of the feeding radiation element 120 may substantially have a triangular shape. Specifically, the bridging portion 140 has a first end 141 and a second end 142. The width W2 of the first end 141 of the bridging portion 140 is greater than or equal to the width W3 of the second end 142 of the bridging portion 140. In addition, the first end 141 of the bridging portion 140 is coupled to the body portion 130 and is adjacent to the feeding point FP. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0).

The extension portion 150 of the feeding radiation element 120 may substantially have a meandering shape. The extension portion 150 may have the smallest width among the feeding radiation element 120. In other words, the width W4 of the extension portion 150 is shorter than the width W1 of the body portion 130, and is also shorter or equal to the widths W2 and W3 of the bridging portion 140. Specifically, the extension portion 150 has a first end 151 and a second end 152. The first end 151 of the extension portion 150 is coupled to the second end 142 of the bridging portion 140. The second end 152 of the extension portion 150 is an open end. The second end 152 of the extension portion 150 and the second end 132 of the body portion 130 substantially extend in opposite directions and away from each other. That is, the bridging portion 140 is coupled between the body portion 130 and the extension portion 150.

The first grounding radiation element 160 is coupled to a ground voltage VSS and includes a first protruding portion 165. The ground voltage VSS may be provided by a system ground plane of the antenna structure 100 (not shown). The first grounding radiation element 160 may substantially have a relatively long straight-line shape. The first protruding portion 165 may substantially have a trapezoidal shape. In some embodiments, the first grounding radiation element 160 is a ground copper foil, which extends onto the first surface E1 or the second surface E2 of the substrate 110. However, the invention is not limited thereto. In alternative embodiments, the antenna structure 100 further includes an auxiliary ground element (not shown), which extends onto the first surface E1 of the substrate 110 and is coupled to the first grounding radiation element 160.

The second grounding radiation element 170 includes a second protruding portion 175, which extends toward the first protruding portion 165. The second grounding radiation element 170 may substantially have a relatively short straight-line shape. The second protruding portion 175 may substantially have an inverted trapezoidal shape. A bowtie structure or a symmetrical structure may be formed by the first protruding portion 165 and the second protruding portion 175. In some embodiments, the second grounding radiation element 170 is disposed on the second surface E2 of the substrate 110. However, the invention is not limited thereto. In alternative embodiments, the second grounding radiation element 170 is disposed on another plane which is different from the first surface E1 and the second surface E2 of the substrate 110. The bridging portion 140 of the feeding radiation element 120 has a vertical projection on the second surface E2 of the substrate 110, and the vertical projection may partially overlap at least one of the first protruding portion 165 and the second protruding portion 175 of the first grounding radiation element 160. The first circuit element 181 is coupled between the first protruding portion 165 and the second protruding portion 175. For example, the first circuit element 181 may be an inductor. Alternatively, the first circuit element 181 is a capacitor in other embodiments. It should be noted that the first protruding portion 165 and the second protruding portion 175 are both optional elements, and they are removable from the antenna structure 100. In alternative embodiments, the first grounding radiation element 160 does not include the first protruding portion 165, and the second grounding radiation element 170 does not include the second protruding portion 175, such that the first circuit element 181 is directly coupled between the first grounding radiation element 165 and the second grounding radiation element 175.

According to practical measurements, the antenna structure 100 can cover a UWB (Ultra-Wideband) frequency band from 698 MHz to 6000 MHz. Specifically, the UWB frequency band at least includes a first frequency interval from 699 MHz to 960 MHz, and a second frequency interval from 1710 MHz to 2690 MHz. With respect to the antenna principles, the body portion 130 of the feeding radiation element 120 corresponds to the second frequency interval of the antenna structure 100, and the second grounding radiation element 170 and the extension portion 150 of the feeding radiation element 120 corresponds to the first frequency interval of the antenna structure 100. The first circuit element 181 is configured to fine-tune the impedance matching of the first frequency interval, thereby increasing the operation bandwidth of the first frequency interval. Furthermore, the taper designs of the bridging portion 140, the first protruding portion 165, and the second protruding portion 175 can improve the impedance matching of the second frequency interval from 1710 MHz to 2690 MHz.

In some embodiments, the element sizes and element parameters of the antenna structure 100 are described as follows. The thickness H1 of the substrate 110 may be from 0.02 mm to 1.6 mm. The length L1 of the body portion 130 of the feeding radiation element 120 may be shorter than or equal to 0.25 wavelength (λ/4) of the second frequency interval of the antenna structure 100. The total length L2 of the bridging portion 140 and the extension portion 150 of the feeding radiation element 120 may be shorter than or equal to 0.25 wavelength (λ/4) of the first frequency interval of the antenna structure 100. The length L3 of the second grounding radiation element 170 may be shorter than or equal to 0.25 wavelength (λ/4) of the first frequency interval of the antenna structure 100. The inductance of the first circuit element 181 may be greater than or equal to 1 nH. In the feeding radiation element 120, the width W1 of the body portion 130 may be shorter than or equal to 4 mm, the width W2 of the first end 141 of the bridging portion 140 may be shorter than or equal to 3 mm, the width W3 of the second end 142 of the bridging portion 140 may be shorter than or equal to 2 mm, and the width W4 of the extension portion 150 may be shorter than or equal to 2 mm. The above ranges of element sizes are calculated and obtained according to many experiment results, and they help to optimize the operation bandwidth and impedance matching of the antenna structure 100.

Figure 2:
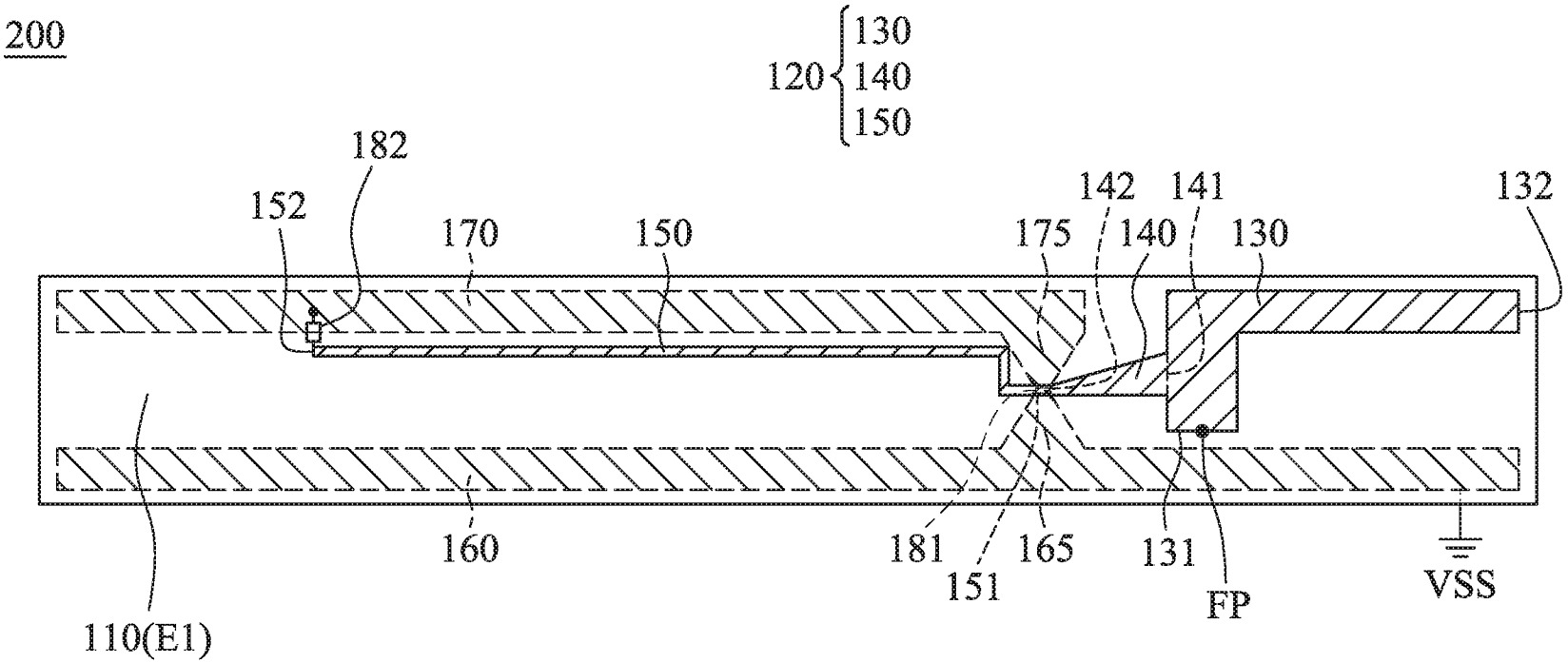
FIG. 2 is a top view of an antenna structure according to an embodiment of the invention.

FIG. 2 is a top view of an antenna structure 200 according to an embodiment of the invention. FIG. 2 is similar to FIG. 1A. In the embodiment of FIG. 2, the antenna structure 200 further includes a second circuit element 182. The second circuit element 182 is disposed on the first surface E1 of the substrate 110, and is coupled between the second grounding radiation element 170 and the extension portion 150 of the feeding radiation element 120. Specifically, the second circuit element 182 has a first terminal and a second terminal. The first terminal of the second circuit element 182 is coupled to the second end 152 of the extension portion 150. The second terminal of the second circuit element 182 may be coupled through a conductive via element (not shown) to the second grounding radiation element 170. For example, the second circuit element 182 may be a capacitor whose capacitance may be greater than or equal to 0.1 pF. According to practical measurements, the second circuit element 182 is configured to fine-tune the impedance matching of the second frequency interval (e.g., from 1710 MHz to 2690 MHz) of the antenna structure 200, thereby increasing the operation bandwidth of the second frequency interval. In other embodiments, the second circuit element 182 is replaced with an inductor. Other features of the antenna structure 200 of FIG. 2 are similar to those of the antenna structure 100 of FIGS. 1A, 1B, 1C and 1D. Accordingly, the two embodiments can achieve similar levels of performance.

Figure 3:
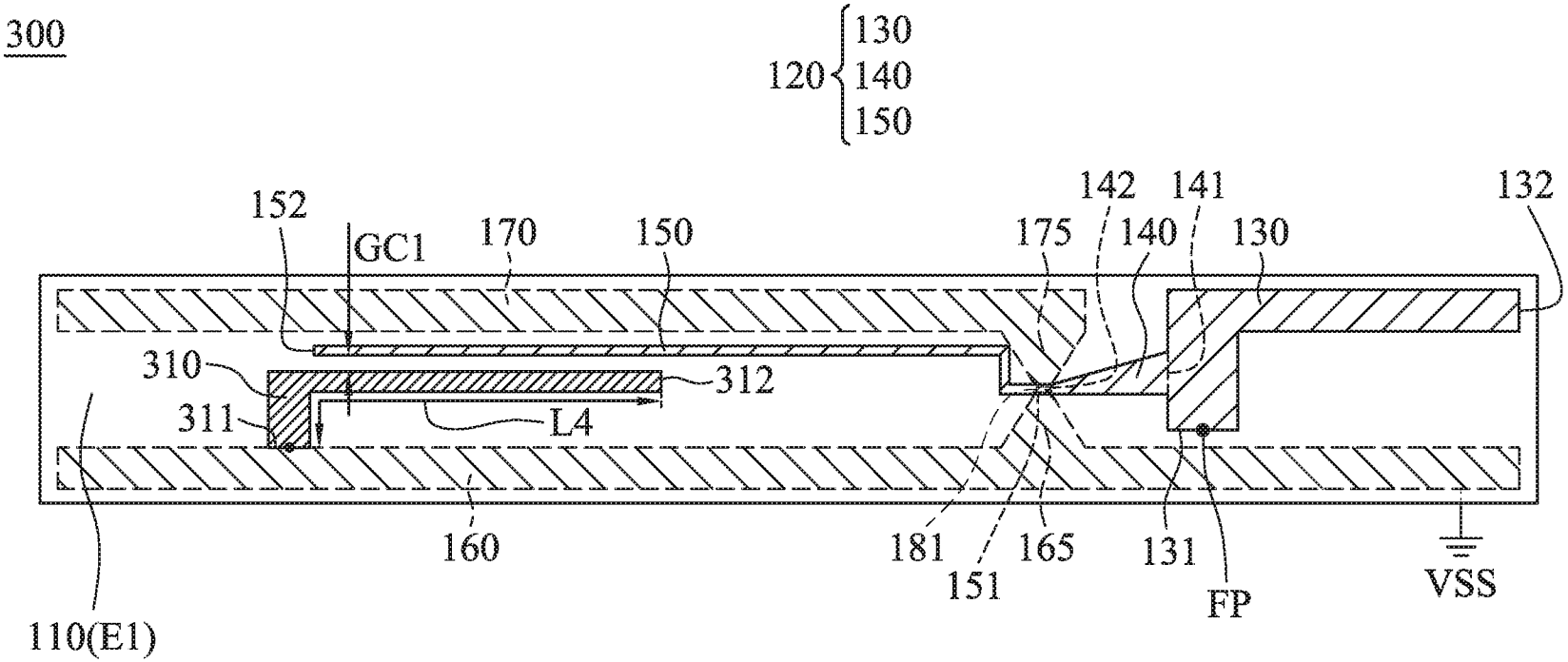
FIG. 3 is a top view of an antenna structure according to an embodiment of the invention.

FIG. 3 is a top view of an antenna structure 300 according to an embodiment of the invention. FIG. 3 is similar to FIG. 1A. In the embodiment of FIG. 3, the antenna structure 300 further includes a parasitic radiation element 310, which may be made of a metal material and disposed on the first surface E1 of the substrate 110. The parasitic radiation element 310 may substantially have an L-shape. Specifically, the parasitic radiation element 310 has a first end 311 and a second end 312. The first end 311 of the parasitic radiation element 310 is coupled through a conductive via element (not shown) to the first grounding radiation element 160. The second end 312 of the parasitic radiation element 310 is an open end. The second end 312 of the parasitic radiation element 310 is adjacent to the extension portion 150 of the feeding radiation element 120, but it is separate from the extension portion 150 of the feeding radiation element 120. This means that a coupling gap GC1 is formed between the parasitic radiation element 310 and the extension portion 150 of the feeding radiation element 120. The width of the coupling gap GC1 may be shorter than 2 mm. According to practical measurements, the parasitic radiation element 310 is configured to fine-tune the impedance matching of the second frequency interval (e.g., from 1710 MHz to 2690 MHz) of the antenna structure 300, thereby increasing the operation bandwidth of the second frequency interval. The length L4 of the parasitic radiation element 310 may be shorter than or equal to 0.25 wavelength (λ/4) of the second frequency interval of the antenna structure 300. In alternative embodiments, the parasitic radiation element 310 is disposed on the second surface E2 of the substrate 110, so that the first end 311 of the parasitic radiation element 310 may be coupled directly to the first grounding radiation element 160. Other features of the antenna structure 300 of FIG. 3 are similar to those of the antenna structure 100 of FIGS. 1A, 1B, 1C and 1D. Accordingly, the two embodiments can achieve similar levels of performance.

Figure 4:
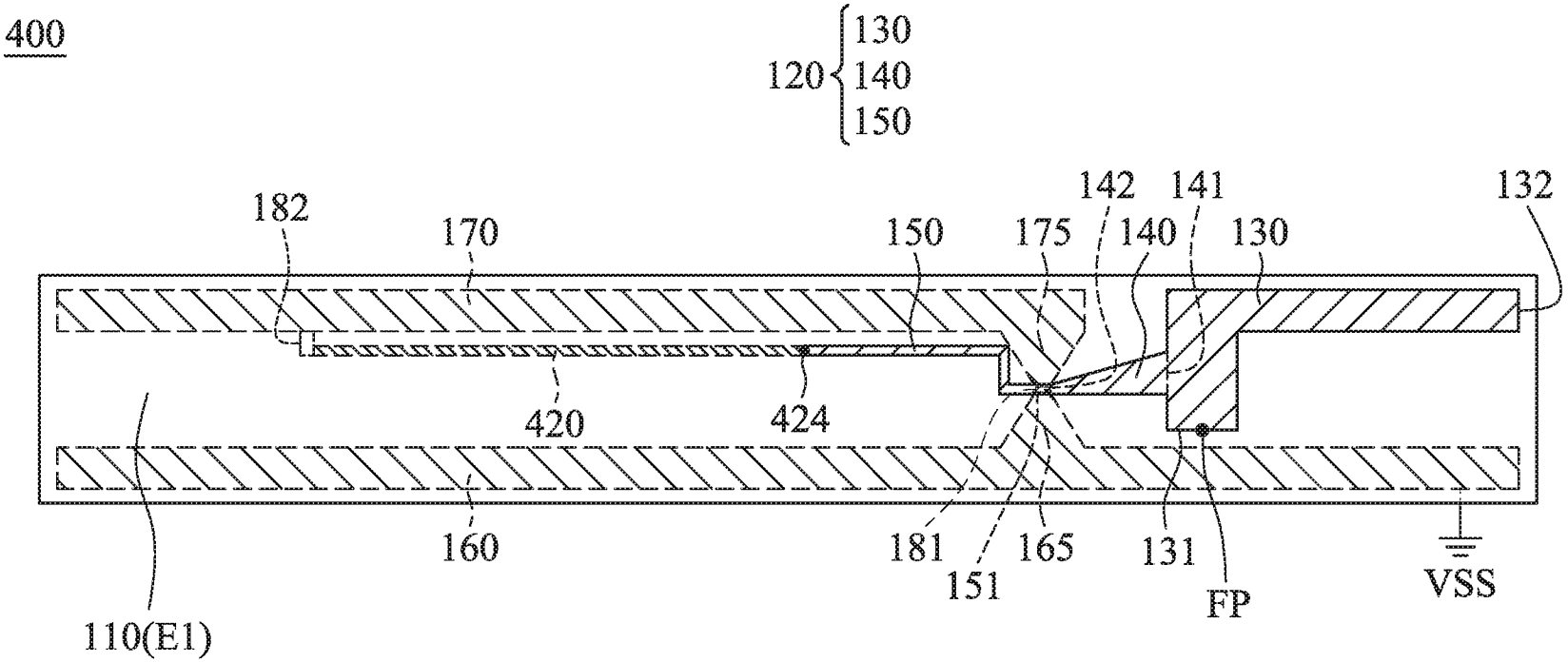
FIG. 4 is a top view of an antenna structure according to an embodiment of the invention.

FIG. 4 is a top view of an antenna structure 400 according to an embodiment of the invention. FIG. 4 is similar to FIG. 2. In the embodiment of FIG. 4, the antenna structure 400 further includes a first additional radiation element 420 and one or more first conductive via elements 424. The first additional radiation element 420 may be made of a metal material. The first additional radiation element 420 and the second circuit element 182 may be both disposed on the second surface E2 of the substrate 110. In some embodiments, the first additional radiation element 420 and the extension portion 150 of the feeding radiation element 120 substantially have identical widths. The first conductive via elements 424 penetrate the substrate 110. The extension portion 150 of the feeding radiation element 120 is coupled through the first conductive via elements 424 and the first additional radiation element 420 to the second circuit element 182. That is, the second circuit element 182 is coupled between the second grounding radiation element 170 and the first additional radiation element 420. Since the second grounding radiation element 170, the second circuit element 182, and the first additional radiation element 420 are disposed on the same plane, such a design can reduce the difficulty of fabricating the second circuit element 182, without affecting the operation bandwidth of the antenna structure 400. It should be noted that the length of the extension portion 150 of the feeding radiation element 120 can be correspondingly reduced after the first additional radiation element 420 is included. Other features of the antenna structure 400 of FIG. 4 are similar to those of the antenna structure 200 of FIG. 2. Accordingly, the two embodiments can achieve similar levels of performance.

Figure 5:
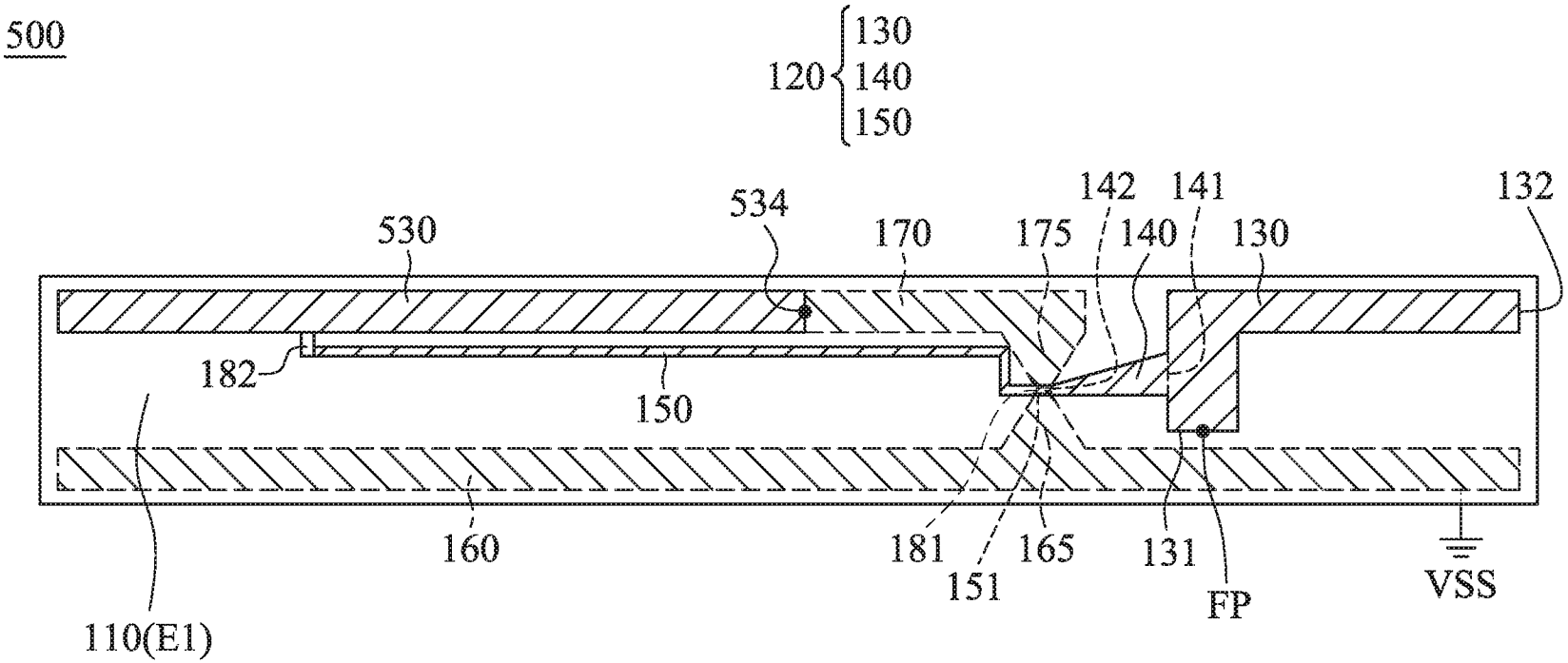
FIG. 5 is a top view of an antenna structure according to an embodiment of the invention.

FIG. 5 is a top view of an antenna structure 500 according to an embodiment of the invention. FIG. 5 is similar to FIG. 2. In the embodiment of FIG. 5, the antenna structure 500 further includes a second additional radiation element 530 and one or more second conductive via elements 534. The second additional radiation element 530 may be made of a metal material. The second additional radiation element 530 and the second circuit element 182 may be both disposed on the first surface E1 of the substrate 110. In some embodiments, the second additional radiation element 530 and the second grounding radiation element 170 substantially have identical widths. The second conductive via elements 534 penetrate the substrate 110. The second grounding radiation element 170 is coupled through the second conductive via elements 534 and the second additional radiation element 530 to the second circuit element 182. That is, the second circuit element 182 is coupled between the second additional radiation element 530 and the extension portion 150 of the feeding radiation element 120. Since the second additional radiation element 530, the second circuit element 182, and the feeding radiation element 120 are disposed on the same plane, such a design can reduce the difficulty of fabricating the second circuit element 182, without affecting the operation bandwidth of the antenna structure 500. Other features of the antenna structure 500 of FIG. 5 are similar to those of the antenna structure 200 of FIG. 2. Accordingly, the two embodiments can achieve similar levels of performance.

Figure 6A:
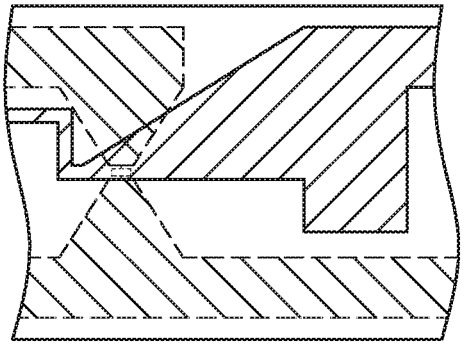
FIG. 6A is a top view of an antenna structure according to an embodiment of the invention.
Figure 6B:
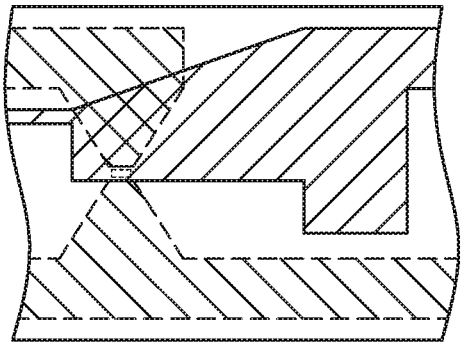
FIG. 6B is a top view of an antenna structure according to an embodiment of the invention.
Figure 6C:
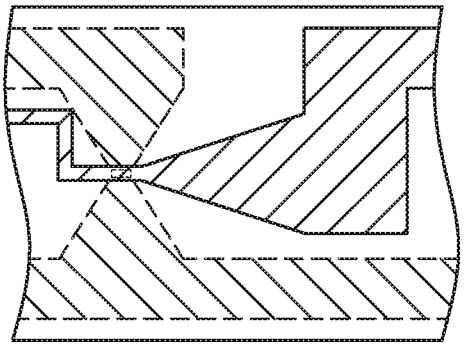
FIG. 6C is a top view of an antenna structure according to an embodiment of the invention.
Figure 6D:
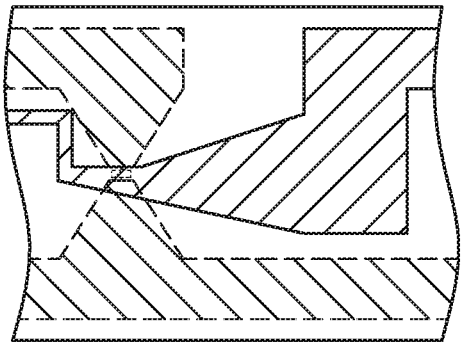
FIG. 6D is a top view of an antenna structure according to an embodiment of the invention.

FIG. 6A is a top view of an antenna structure 601 according to an embodiment of the invention. FIG. 6B is a top view of an antenna structure 602 according to an embodiment of the invention. FIG. 6C is a top view of an antenna structure 603 according to an embodiment of the invention. FIG. 6D is a top view of an antenna structure 604 according to an embodiment of the invention. As shown in FIGS. 6A, 6B, 6C and 6D, the aforementioned bridging portion 140 may substantially have a trapezoidal shape, or any sort of triangular shape, so as to be able to fine-tune the coupling amount between itself and the first protruding portion 165 or the second protruding portion 175. According to practical measurements, if the aforementioned coupling amount increases, the operation frequency of the antenna structure may rise correspondingly, and if the aforementioned coupling amount decreases, the operation frequency of the antenna structure may drop correspondingly.

Figure 7A:
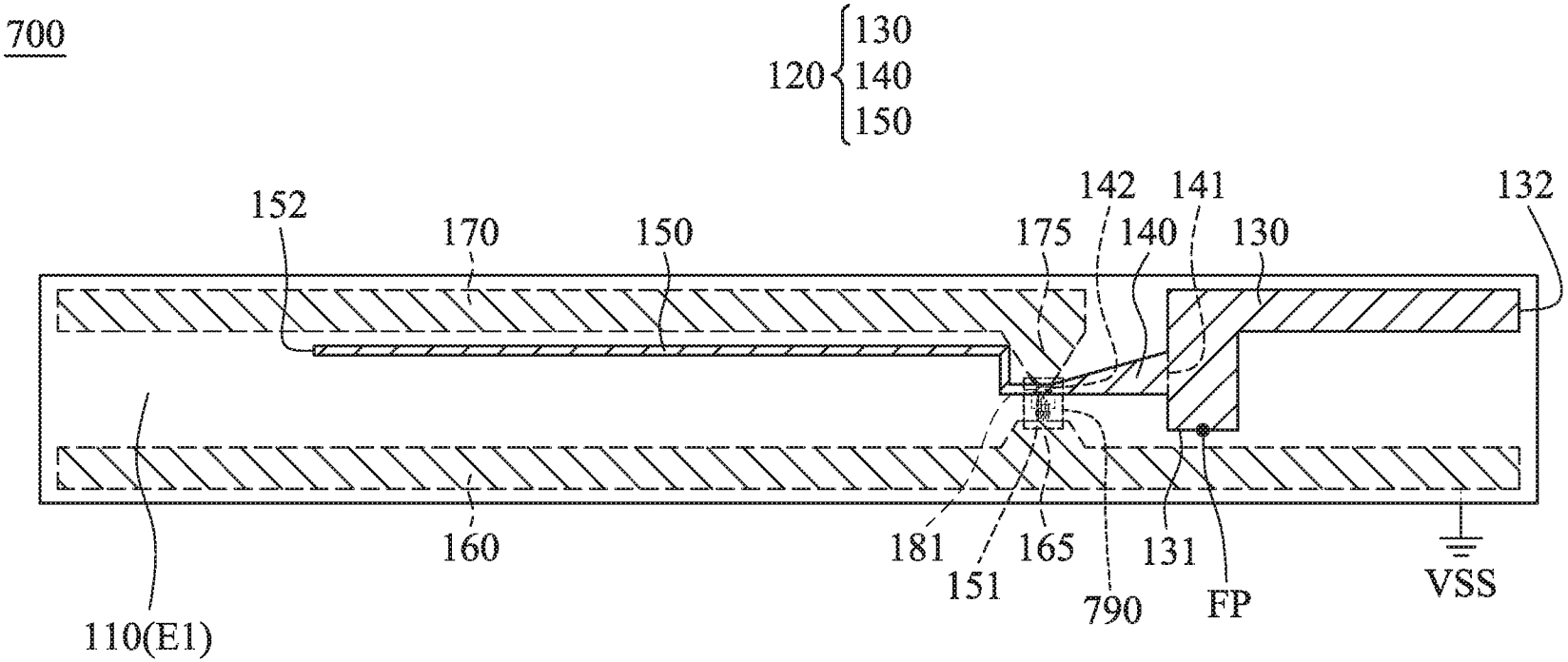
FIG. 7A is a top view of an antenna structure according to an embodiment of the invention.
Figure 7B:
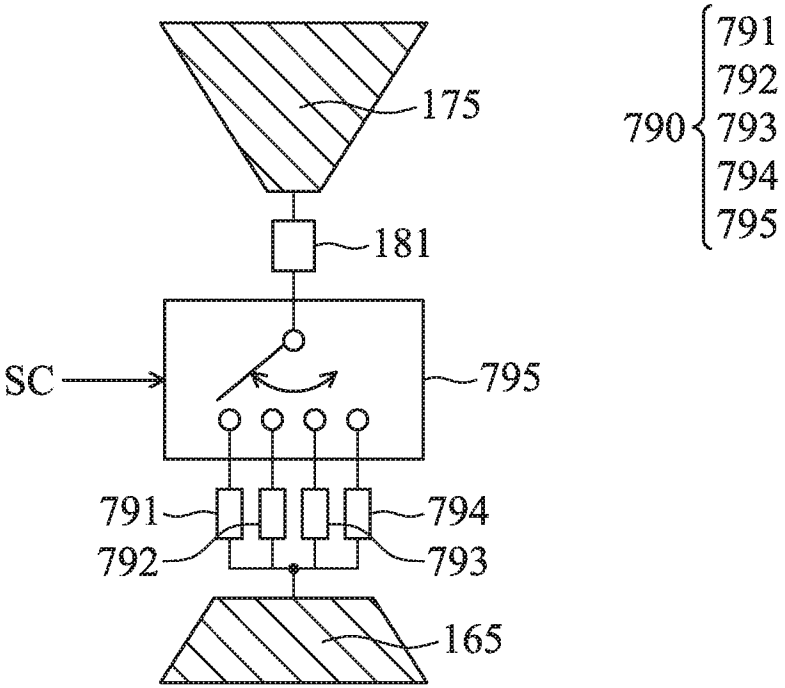
FIG. 7B is a diagram of a tuning circuit according to an embodiment of the invention.

FIG. 7A is a top view of an antenna structure 700 according to an embodiment of the invention. FIG. 7A is similar to FIG. 1A. In the embodiment of FIG. 7A, the antenna structure 700 further includes a tuning circuit 790. FIG. 7B is a diagram of the tuning circuit 790 according to an embodiment of the invention. As shown in FIG. 7A and FIG. 7B, the tuning circuit 790 includes a plurality of impedance elements 791, 792, 793 and 794 and a switch element 795. For example, the impedance elements 791, 792, 793 and 794 may be a plurality of inductors with different inductances, a plurality of capacitors with different capacitances, or any combination thereof, but they are not limited thereto. The switch element 795 selects one of the impedance elements 791, 792, 793 and 794 according to a control signal SC, and the first circuit element 181 is coupled through the selected impedance element to the first grounding radiation element 160. For example, the control signal SC may be generated by a processor (not shown) according to a user's input. According to practical measurements, the operation bandwidth of the antenna structure 700 can be significantly increased by using the tuning circuit 790 for selecting different grounding impedance values. It should be noted that the number of the impedance elements 791, 792, 793 and 794 is not limited in the invention, and the shape of the first protruding portion 165 of the first grounding radiation element 160 is correspondingly adjustable after the tuning circuit 790 is included. Other features of the antenna structure 700 of FIGS. 7A and 7B are similar to those of the antenna structure 100 of FIGS. 1A, 1B, 1C and 1D. Accordingly, the two embodiments can achieve similar levels of performance.

Figure 8:
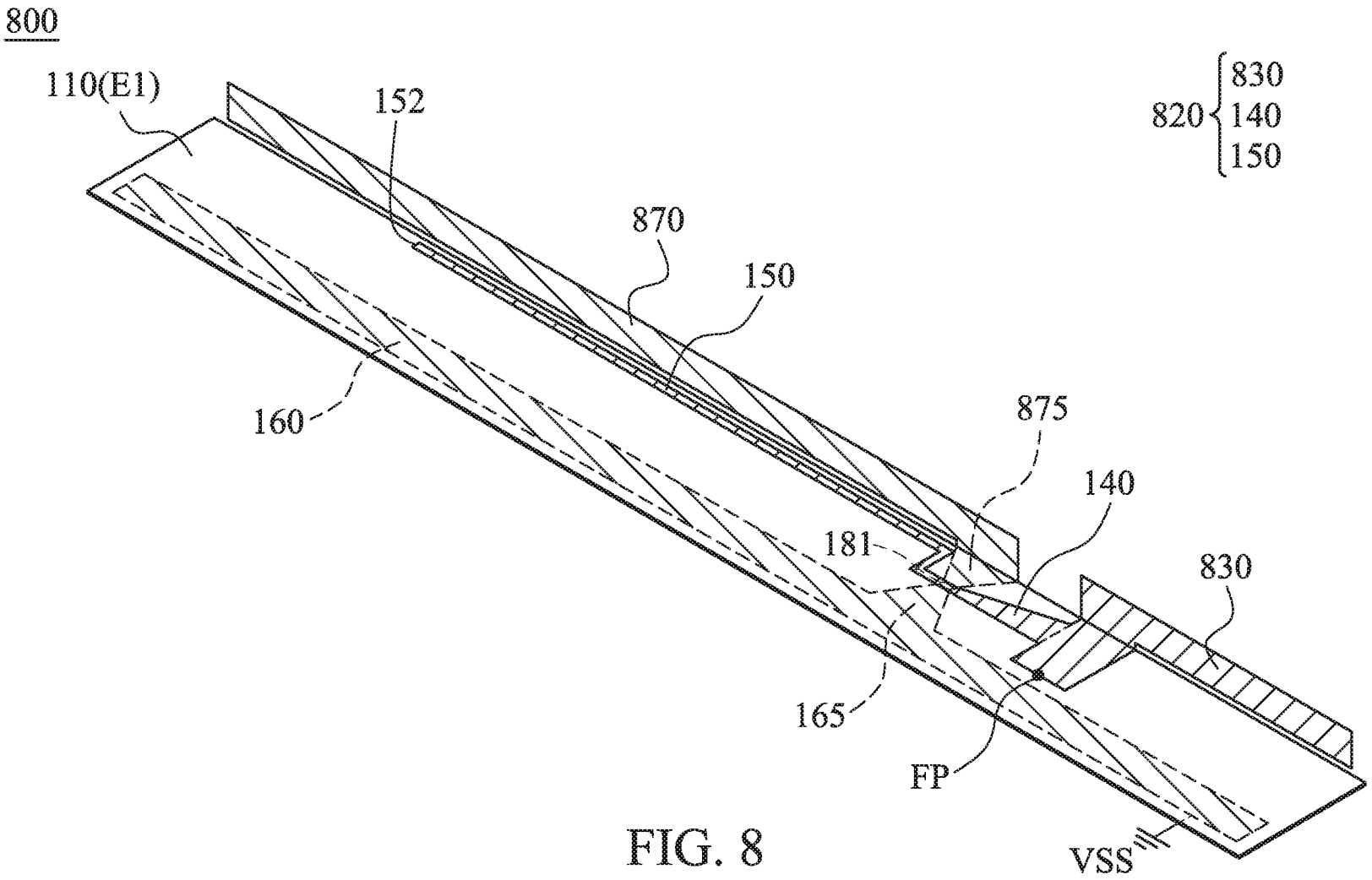
FIG. 8 is a perspective view of an antenna structure according to an embodiment of the invention.

FIG. 8 is a perspective view of an antenna structure 800 according to an embodiment of the invention. FIG. 8 is similar to FIG. 1A. In the embodiment of FIG. 8, a second grounding radiation element 870 of the antenna structure 800 is at least partially disposed on a plane which is substantially perpendicular to the first surface E1 of the substrate 110, but a second protruding portion 875 of the second grounding radiation element 870 is still disposed on the second surface E2 of the substrate 110. Furthermore, a body portion 830 of a feeding radiation element 820 of the antenna structure 800 is at least partially disposed on the aforementioned plane which is substantially perpendicular to the first surface E1 of the substrate 110. That is, the feeding radiation element 820 and the second grounding radiation element 870 may be planar structures, 3D (Three-dimensional) structures, or any combination thereof, so as to save the design space on the substrate 110. Other features of the antenna structure 800 of FIG. 8 are similar to those of the antenna structure 100 of FIGS. 1A, 1B, 1C and 1D. Accordingly, the two embodiments can achieve similar levels of performance.

Figure 9:
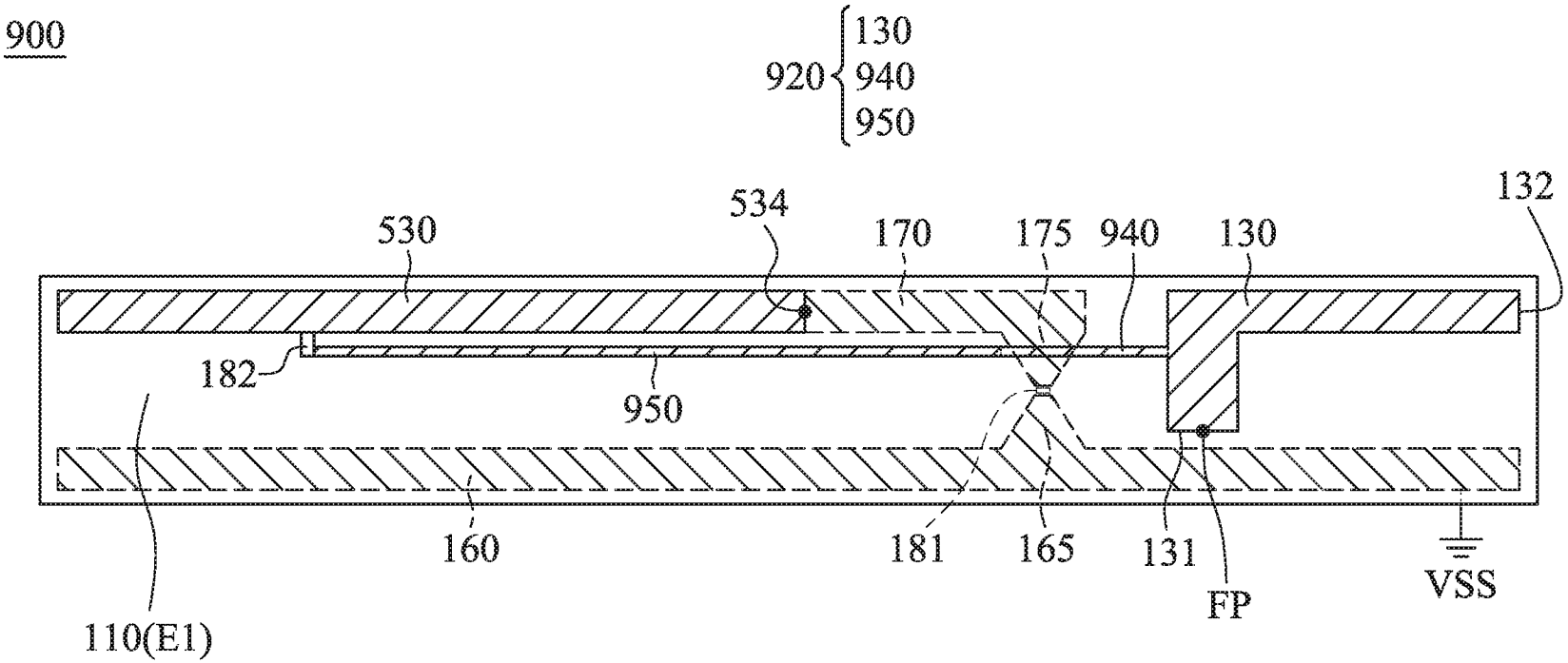
FIG. 9 is a top view of an antenna structure according to an embodiment of the invention.

FIG. 9 is a top view of an antenna structure 900 according to an embodiment of the invention. FIG. 9 is similar to FIG. 5. In the embodiment of FIG. 9, a feeding radiation element 920 of the antenna structure 900 includes a body portion 130, a bridging portion 940, and an extension portion 950. The bridging portion 940 may substantially have a rectangular shape, and the extension portion 950 may substantially have a thin rectangular shape. The different shapes of the bridging portion 940 and the extension portion 950 can increase the design flexibility of the antenna structure 900. Other features of the antenna structure 900 of FIG. 9 are similar to those of the antenna structure 500 of FIG. 5. Accordingly, the two embodiments can achieve similar levels of performance.

Figure 10:
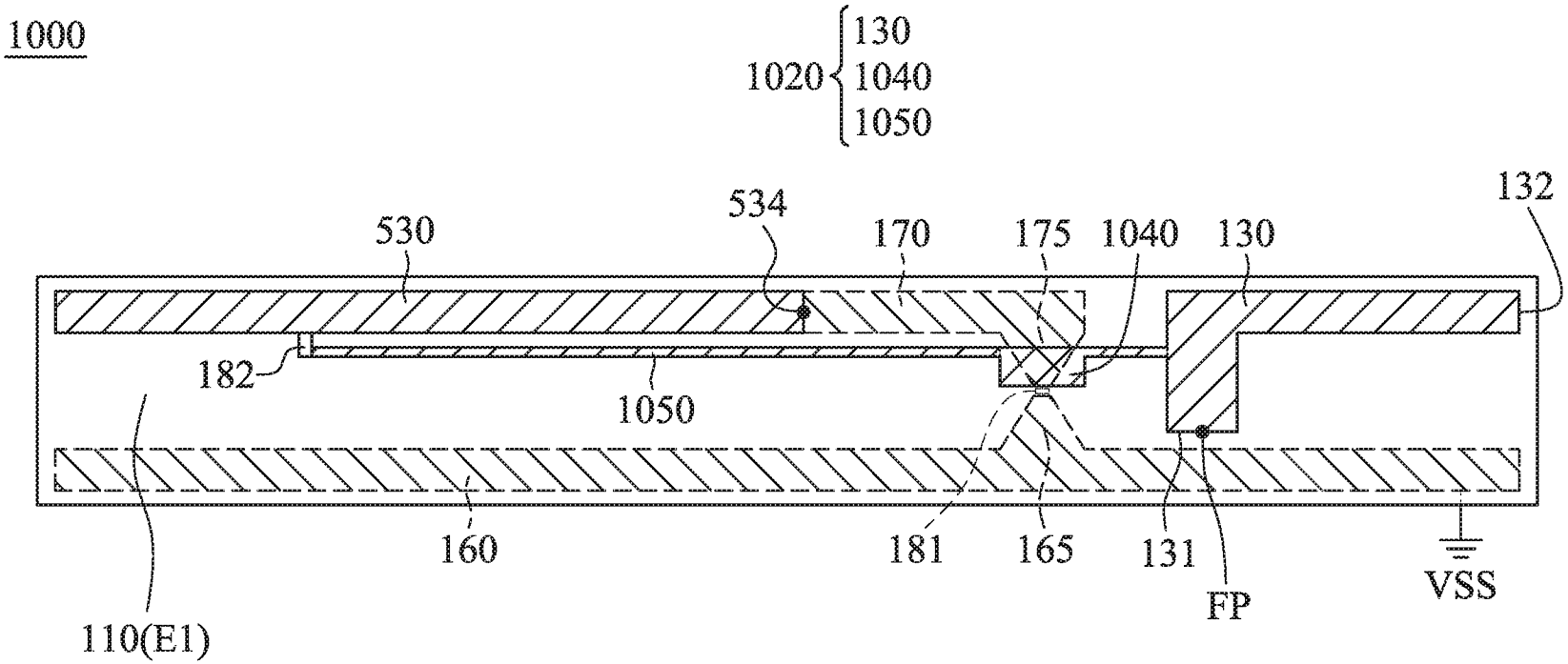
FIG. 10 is a top view of an antenna structure according to an embodiment of the invention.

FIG. 10 is a top view of an antenna structure 1000 according to an embodiment of the invention. FIG. 10 is similar to FIG. 5. In the embodiment of FIG. 10, a feeding radiation element 1020 of the antenna structure 1000 includes a body portion 1030, a bridging portion 1040, and an extension portion 1050. The bridging portion 1040 may substantially have a T-shape, and the extension portion 1050 may substantially have a thin rectangular shape. The different shapes of the bridging portion 1040 and the extension portion 1050 can increase the design flexibility of the antenna structure 1000. Other features of the antenna structure 1000 of FIG. 10 are similar to those of the antenna structure 500 of FIG. 5. Accordingly, the two embodiments can achieve similar levels of performance.

Figure 11:
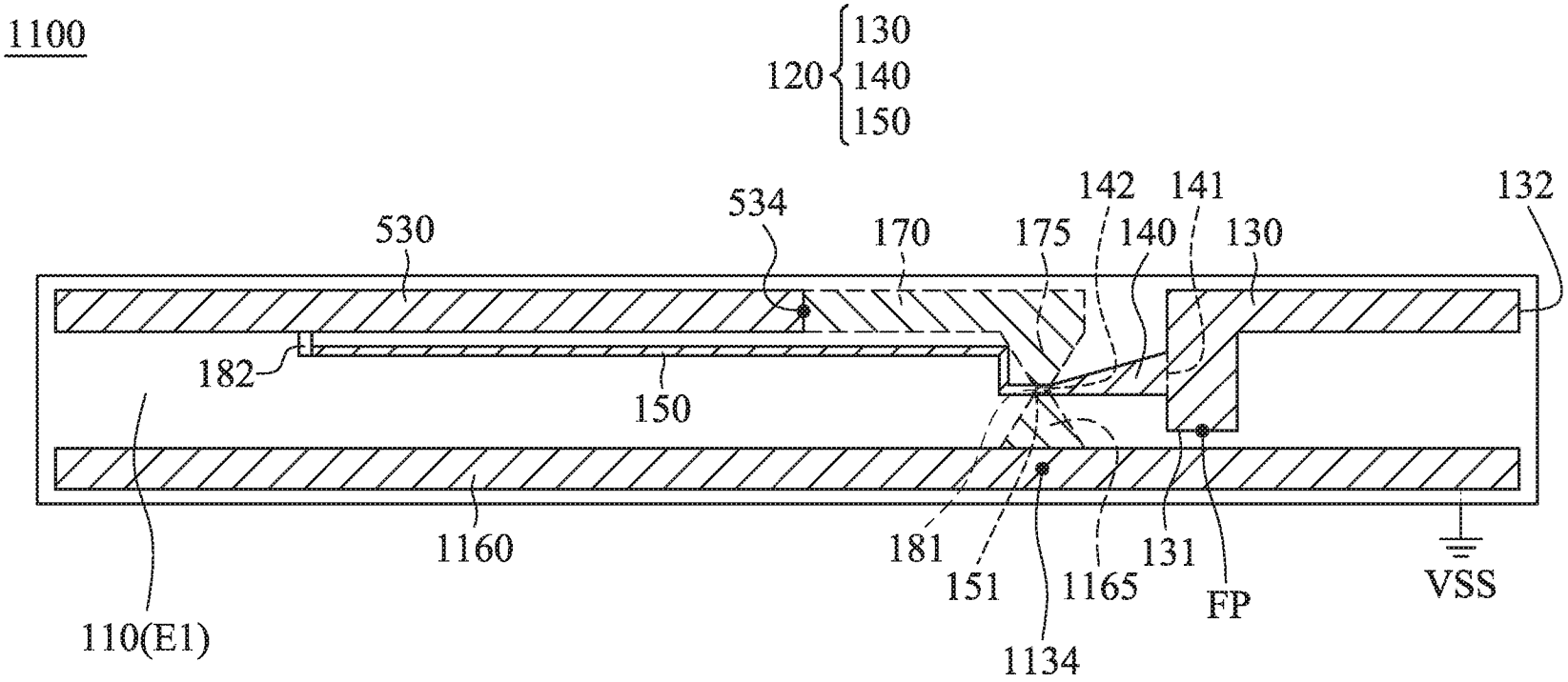
FIG. 11 is a top view of an antenna structure according to an embodiment of the invention.

FIG. 11 is a top view of an antenna structure 1100 according to an embodiment of the invention. FIG. 11 is similar to FIG. 5. In the embodiment of FIG. 11, the antenna structure 1100 further includes one or more third conductive via elements 1134, and a first grounding radiation element 1160 of the antenna structure 1100 is disposed on the first surface E1 of the substrate 110. The third conductive via elements 1134 penetrate the substrate 110. The first grounding radiation element 1160 is coupled through the third conductive via elements 1134 to a first protruding portion 1165 on the second surface E2 of the substrate 110. That is, the first grounding radiation element 1160 and its first protruding portion 1165 are respectively disposed on the first surface E1 and the second surface E2 of the substrate 110, thereby increasing the design flexibility of the antenna structure 1100. Other features of the antenna structure 1100 of FIG. 11 are similar to those of the antenna structure 500 of FIG. 5. Accordingly, the two embodiments can achieve similar levels of performance.

Figure 12:
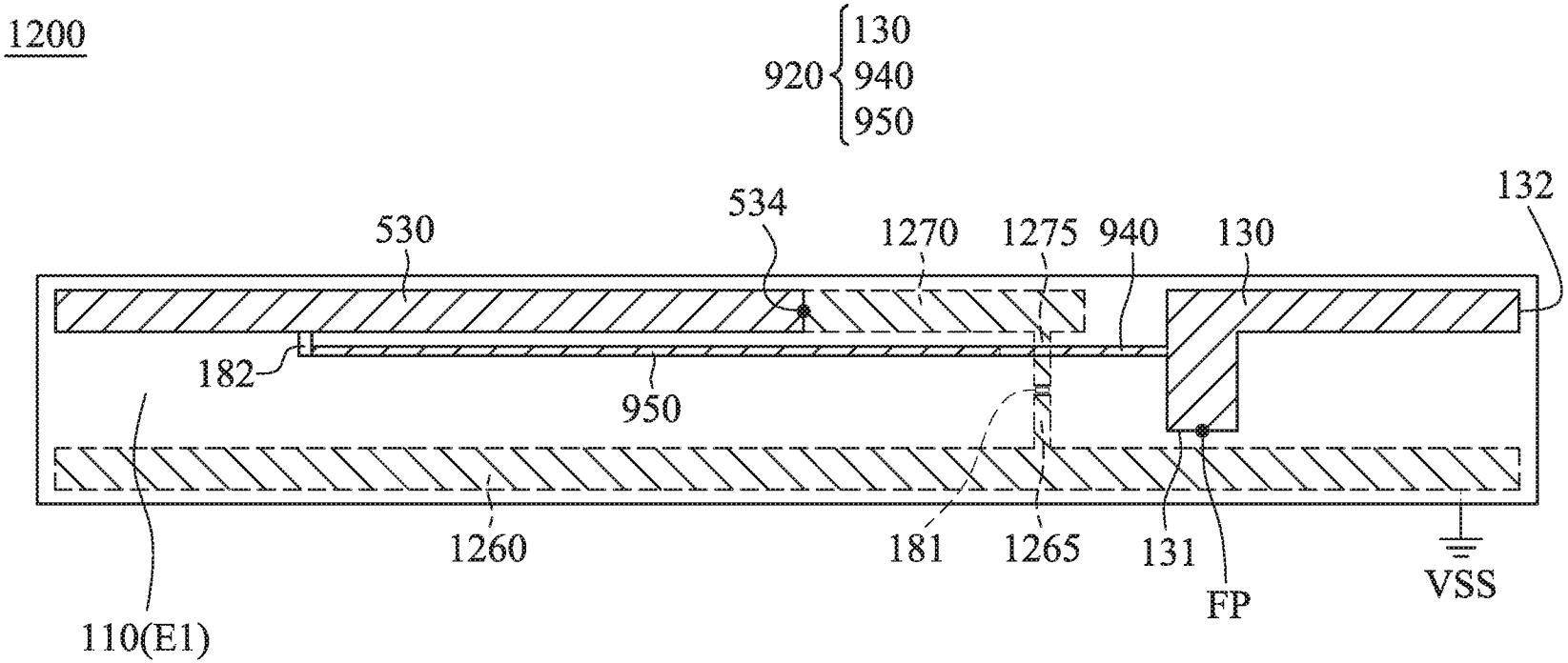
FIG. 12 is a top view of an antenna structure according to an embodiment of the invention.

FIG. 12 is a top view of an antenna structure 1200 according to an embodiment of the invention. FIG. 12 is similar to FIG. 9. In the embodiment of FIG. 12, a first grounding radiation element 1260 of the antenna structure 1200 includes a first protruding portion 1265, and a second grounding radiation element 1270 of the antenna structure 1200 includes a second protruding portion 1275. Each of the first protruding portion 1265 and the second protruding portion 1275 may substantially have a straight-line shape. The first circuit element 181 is coupled between the first protruding portion 1265 and the second protruding portion 1275. The different shapes of the first protruding portion 1265 and the second protruding portion 1275 can increase the design flexibility of the antenna structure 1200. Other features of the antenna structure 1200 of FIG. 12 are similar to those of the antenna structure 900 of FIG. 9. Accordingly, the two embodiments can achieve similar levels of performance.

Figure 13:
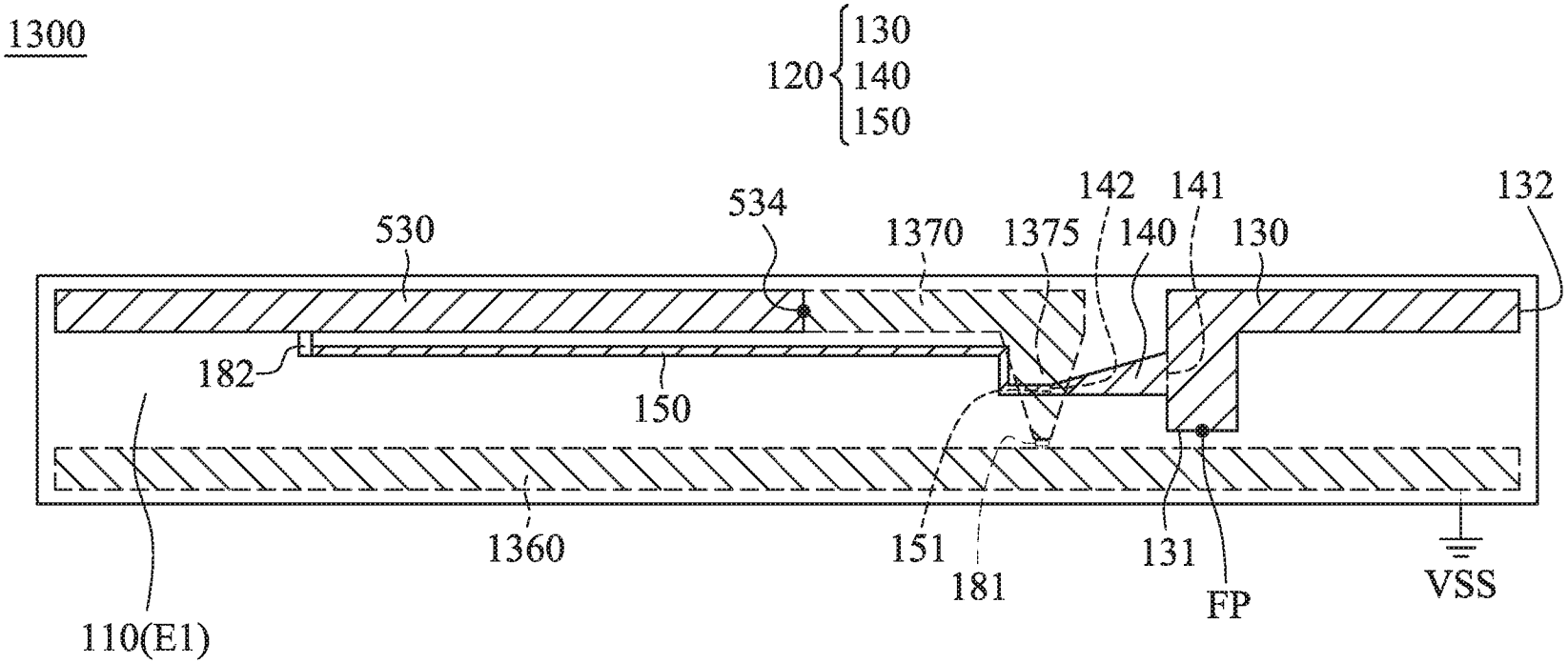
FIG. 13 is a top view of an antenna structure according to an embodiment of the invention.

FIG. 13 is a top view of an antenna structure 1300 according to an embodiment of the invention. FIG. 13 is similar to FIG. 5. In the embodiment of FIG. 13, a first grounding radiation element 1360 of the antenna structure 1300 does not include any first protruding portion, and a second grounding radiation element 1370 of the antenna structure 1300 includes a second protruding portion 1375. The second protruding portion 1375 may substantially have an inverted triangular shape or an inverted trapezoidal shape. The first circuit element 181 is coupled between the second protruding portion 1375 and the first grounding radiation element 1360. The different shapes of the first grounding radiation element 1360 and the second grounding radiation element 1370 can increase the design flexibility of the antenna structure 1300. Other features of the antenna structure 1300 of FIG. 13 are similar to those of the antenna structure 500 of FIG. 5. Accordingly, the two embodiments can achieve similar levels of performance.

Figure 14:
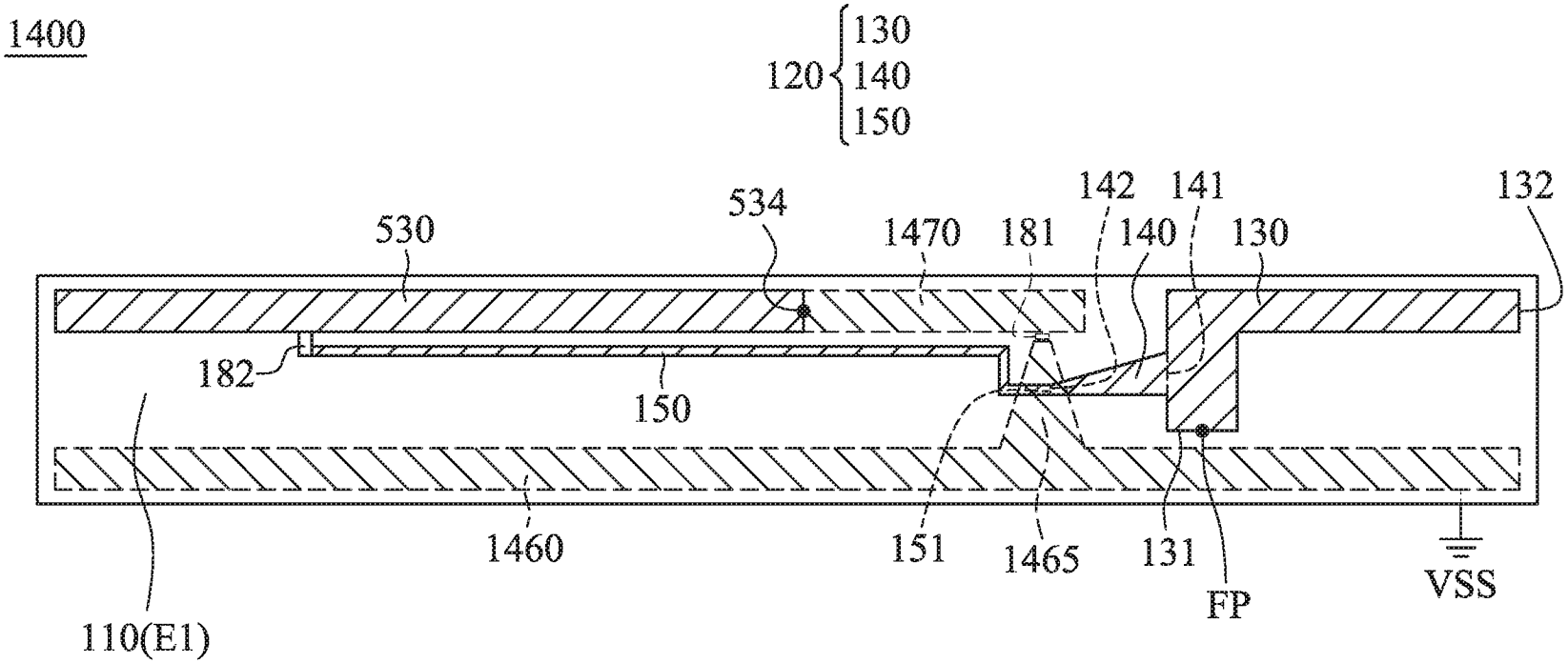
FIG. 14 is a top view of an antenna structure according to an embodiment of the invention.

FIG. 14 is a top view of an antenna structure 1400 according to an embodiment of the invention. FIG. 14 is similar to FIG. 5. In the embodiment of FIG. 14, a first grounding radiation element 1460 of the antenna structure 1400 includes a first protruding portion 1465, and a second grounding radiation element 1470 of the antenna structure 1400 does not include any second protruding portion. The first protruding portion 1465 may substantially have a triangular shape or a trapezoidal shape. The first circuit element 181 is coupled between the first protruding portion 1465 and the second grounding radiation element 1470. The different shapes of the first grounding radiation element 1460 and the second grounding radiation element 1470 can increase the design flexibility of the antenna structure 1400. Other features of the antenna structure 1400 of FIG. 14 are similar to those of the antenna structure 500 of FIG. 5. Accordingly, the two embodiments can achieve similar levels of performance.

The invention proposes a novel antenna structure. In comparison to the conventional design, the invention has at least the advantages of small size, wide bandwidth, and low manufacturing cost, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-14. The invention may merely include any one or more features of any one or more embodiments of FIGS. 1-14. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a substrate, having a first surface and a second surface opposite to each other;

a feeding radiation element, comprising a body portion, a bridging portion, and an extension portion, wherein the body portion has a feeding point, and the bridging portion is coupled between the body portion and the extension portion;

a first grounding radiation element, coupled to a ground voltage;

a second grounding radiation element; and a first circuit element, coupled between the first grounding radiation element and the second grounding radiation element;

wherein the bridging portion of the feeding radiation element is disposed on the first surface of the substrate, and the first circuit element is disposed on the second surface of the substrate.

2. The antenna structure as claimed in claim 1, wherein the antenna structure covers a UWB (Ultra-Wideband) frequency band which at least comprises a first frequency interval from 699 MHz to 960 MHz and a second frequency interval from 1710 MHz to 2690 MHz.

3. The antenna structure as claimed in claim 1, wherein the body portion of the feeding radiation element substantially has an L-shape.

4. The antenna structure as claimed in claim 2, wherein a length of the body portion of the feeding radiation element is shorter than or equal to 0.25 wavelength of the second frequency interval.

5. The antenna structure as claimed in claim 1, wherein the bridging portion of the feeding radiation element substantially has a triangular shape, a T-shape, or a rectangular shape.

6. The antenna structure as claimed in claim 1, wherein the extension portion of the feeding radiation element substantially has a meandering shape or a thin rectangular shape, and the extension portion has the smallest width among the feeding radiation element.

7. The antenna structure as claimed in claim 2, wherein a total length of the bridging portion and the extension portion of the feeding radiation element is shorter than or equal to 0.25 wavelength of the first frequency interval.

8. The antenna structure as claimed in claim 1, wherein the first grounding radiation element substantially has a relatively long straight-line shape and further comprises a first protruding portion, and the first protruding portion substantially has a trapezoidal shape or a straight-line shape.

9. The antenna structure as claimed in claim 8, wherein the second grounding radiation element substantially has a relatively short straight-line shape and further comprises a second protruding portion, and the second protruding portion substantially has an inverted trapezoidal shape or a straight-line shape.

10. The antenna structure as claimed in claim 2, wherein a length of the second grounding radiation element is shorter than or equal to 0.25 wavelength of the first frequency interval.

11. The antenna structure as claimed in claim 1, wherein the first circuit element is an inductor, and an inductance of the inductor is greater than or equal to 1 nH.

12. The antenna structure as claimed in claim 9, wherein the bridging portion of the feeding radiation element has a vertical projection on the second surface of the substrate, and the vertical projection partially overlaps at least one of the first protruding portion and the second protruding portion.

13. The antenna structure as claimed in claim 1, further comprising:

a second circuit element, coupled between the second grounding radiation element and the extension portion of the feeding radiation element.

14. The antenna structure as claimed in claim 13, wherein the second circuit element is a capacitor, and a capacitance of the capacitor is greater than or equal to 0.1 pF.

15. The antenna structure as claimed in claim 13, further comprising:

a first additional radiation element, disposed on the second surface of the substrate; and one or more first conductive via elements, penetrating the substrate, wherein the extension portion of the feeding radiation element is coupled through the first conductive via elements and the first additional radiation element to the second circuit element.

16. The antenna structure as claimed in claim 13, further comprising:

a second additional radiation element, disposed on the first surface of the substrate; and one or more second conductive via elements, penetrating the substrate, wherein the second grounding radiation element is coupled through the second conductive via elements and the second additional radiation element to the second circuit element.

17. The antenna structure as claimed in claim 2, further comprising:

a parasitic radiation element, coupled to the first grounding radiation element, wherein the parasitic radiation element is adjacent to and separate from the extension portion of the feeding radiation element.

18. The antenna structure as claimed in claim 17, wherein a length of the parasitic radiation element is shorter than or equal to 0.25 wavelength of the second frequency interval.

19. The antenna structure as claimed in claim 1, wherein the second grounding radiation element is disposed on the second surface of the substrate, or is partially disposed on a plane which is substantially perpendicular to the first surface of the substrate.

20. The antenna structure as claimed in claim 1, further comprising a tuning circuit which comprises:

a plurality of impedance elements; and a switch element, selecting one of the impedance elements according to a control signal, such that the first circuit element is coupled through the selected impedance element to the first grounding radiation element.

* * * * *